US010463158B2

(12) United States Patent
Lin

(10) Patent No.: US 10,463,158 B2
(45) Date of Patent: Nov. 5, 2019

(54) WALL-MOUNTED FOLDABLE CHAIR

(71) Applicant: YO YUH INST. CO., LTD., Dacun Township, Changhua County (TW)

(72) Inventor: Yong-Hao Lin, Dacun Township, Changhua County (TW)

(73) Assignee: YO YUH INST. CO., LTD., Changhua County (TW)

( * ) Notice: Subject to any disclaimer, the term of this patent is extended or adjusted under 35 U.S.C. 154(b) by 1 day.

(21) Appl. No.: 15/891,357

(22) Filed: Feb. 7, 2018

(65) Prior Publication Data

US 2019/0239651 A1 Aug. 8, 2019

(51) Int. Cl.

| | |
|---|---|
| ***A47C 9/06*** | (2006.01) |
| ***A47C 7/54*** | (2006.01) |
| *A47C 4/04* | (2006.01) |

(52) U.S. Cl.

CPC ..... *A47C 9/06* (2013.01); *A47C 7/543* (2013.01); *A47C 4/04* (2013.01)

(58) Field of Classification Search

CPC .. A47C 9/06; A47C 7/543; A47C 7/54; A47C 4/04; A47C 1/126; B64D 11/0698; B64D 11/0691

USPC ..... 297/14

See application file for complete search history.

(56) References Cited

U.S. PATENT DOCUMENTS

| | | | | |
|---|---|---|---|---|
| 2,257,211 A * | 9/1941 | Willoughby | B60N 2/3047 | 248/240.2 |
| 6,042,178 A * | 3/2000 | Hetherington | A47C 9/06 | 297/14 |
| 6,343,834 B1 * | 2/2002 | Wurmlinger | A47C 9/06 | 108/134 |
| 6,729,685 B1 * | 5/2004 | Ebalobor | A47C 9/06 | 108/13 |
| 6,807,690 B1 * | 10/2004 | Satterfield | A47K 3/282 | 297/14 |
| 7,195,302 B2 * | 3/2007 | Jovicevic | B60N 2/2809 | 296/65.01 |
| 8,109,563 B2 * | 2/2012 | Hansen | B60N 2/24 | 182/127 |
| 8,550,546 B2 * | 10/2013 | Breit | A47C 9/06 | 297/14 |
| 9,844,272 B1 * | 12/2017 | Vetter | A47C 9/06 | |

* cited by examiner

*Primary Examiner* — Mark R Wendell

(57) ABSTRACT

A wall-mounted foldable chair has: a supporting frame, a rotatable frame, and a seating member. The supporting frame is provided with the two assembling bars fixed on a wall surface, the other end of the supporting frame is connected with an axial tube. The two assembling bars are parallel to each other, the shaft tube is provided with a shaft rod, and the shaft rod is rotatably pivoted to the connecting rod. The rotatable frame is provided with a rotation shaft and at least two supporting leg member parallel to the rotation shaft, the two supporting leg member is capable of standing on the ground, and a connecting bar is horizontally disposed between the two supporting leg members for pivoting at the other end of the connecting rod. The seating member is provided with a pad member and the two secure bars.

4 Claims, 9 Drawing Sheets

A-A

B-B

A-A

WALL-MOUNTED FOLDABLE CHAIR

BACKGROUND OF INVENTION

1. Field of Invention

The present invention relates to a foldable chair structure, and more particularly to a wall-mounted foldable chair.

2. Description of Related Art

According to a prior art, a foldable seat comprises: a supporting frame a rotatable frame, and a seating member. The supporting frame is mainly composed of a two locking bars extending laterally from both ends of a rotating rod. Furthermore, a connecting tube parallel to the rotating rod is connected between the two locking bars. One end of the rotating rod is provided with an elastic sheet and a pressing block on the elastic sheet protruding through a through hole opened on the rotating rod. A connecting rod is pivoted at the connecting tube and a free end of the connecting rod is provided with a through aperture. A rotatable frame is formed as a U-shaped elbow and a rotation shaft is connected to its middle section, and the rotating frame passes through the through aperture of the connecting rod with the rotation shaft. Furthermore, two openings of the U-shaped elbow are connected with a shaft rod. The seating member is provided with two secure bars at its lower end, each secure bar is provided with a receiving opening, the receiving openings respectively sleeves onto the two ends of the rotating rod and the shaft rod, to form a rectangular frame with the secure bars, the rotating rod and the shaft rod. Moreover, the connection between the secure bar and the rotating rod is provided with an elastic sheet having a pressing block and a corresponding pressing hole.

It is not difficult to find shortcomings of the above conventional structure. The main reasons are as follows: When the conventional structure of the chair is unfolded, by pressing the U-shaped elbow of the rotatable frame against the wall, the friction created between the rotatable frame and the wall forms a resistance so as to achieve the support of the rotatable frame relative to the seating member. However, when a user is actually sitting on the seating member, due to the small surface area of the seating member, the weight might completely falls on the front end of the seating member, resulting in uneven bearing of the rotatable frame causing deformation.

Second, since the supporting frame is pivotally connected with a long connecting rod, the rotatable frame forms a U-shaped elbow and is connected to the rotation shaft. With the connection between the rotation shaft and the connected rod, when the chair frame is collapsed, the length of the connecting rod prevents the rotatable frame from moving closer to the supporting frame. In addition, the U-shaped elbow of the rotatable frame cannot achieve a folding effect, instead of increasing the occupied space and reducing the practicality of the structure.

Therefore, it is desirable to provide a wall-mounted foldable chair to mitigate and/or obviate the aforementioned problems.

SUMMARY OF INVENTION

An objective of present invention is to provide a reinforcement for a hub ratchet base which is capable of improving the above-mention problems.

In order to achieve the above mentioned objective, A wall-mounted the foldable chair comprises a supporting frame, a rotatable frame and a seating member. The supporting frame has two L-shaped assembling bars, and an end of each assembling bar is fixed onto a wall surface with a mounting member. Another end of each assembling bar is connected to a horizontal axial tube, and a shaft rod is mounted parallel to the axial tube between the two assembling bars and provided with a pivoted connecting rod. The connecting rod is bent and has an arm section and a supporting section. The rotatable frame is provided with a rotation shaft, at least two parallel supporting leg frames connected to the rotation shaft, and a connecting bar parallel to the rotation shaft and between the two supporting leg. A bottom of each supporting leg member of the rotatable frame is connected to form a U-shape and further provided with an anti-slip pad. The connecting bar is pivotally connected to another end of the connecting rod. The connecting bar of the rotatable frame is further sleeved with two side tubes sandwiching the connecting rod to position the connecting rod at a middle of the connecting bar. Furthermore, an end of each of the two side tubes is provided with a resilient plug, and the two resilient plugs are configured to push against the two supporting leg members and respectively engage the two ends of the connecting bar by a locking member. Therefore, the rotatable frame is able to rotate relative to the supporting frame via the connecting rod. The seating member has a pad member and two parallel secure rods below the pad member. Each of the two secure rods respectively has two assembling holes rotatably and respectively jacket onto two ends of the axial tube of the supporting frame and two ends of the rotation shaft of the rotatable frame, to form a rectangular structure with the axial tube, the rotation shaft and the two secure rods. Accordingly, the seating member moves with the supporting frame and the rotatable frame.

Other objects, advantages, and novel features of invention will become more apparent from the following detailed description when taken in conjunction with the accompanying drawings.

DETAILED DESCRIPTION OF PREFERRED EMBODIMENT

Figure 1:
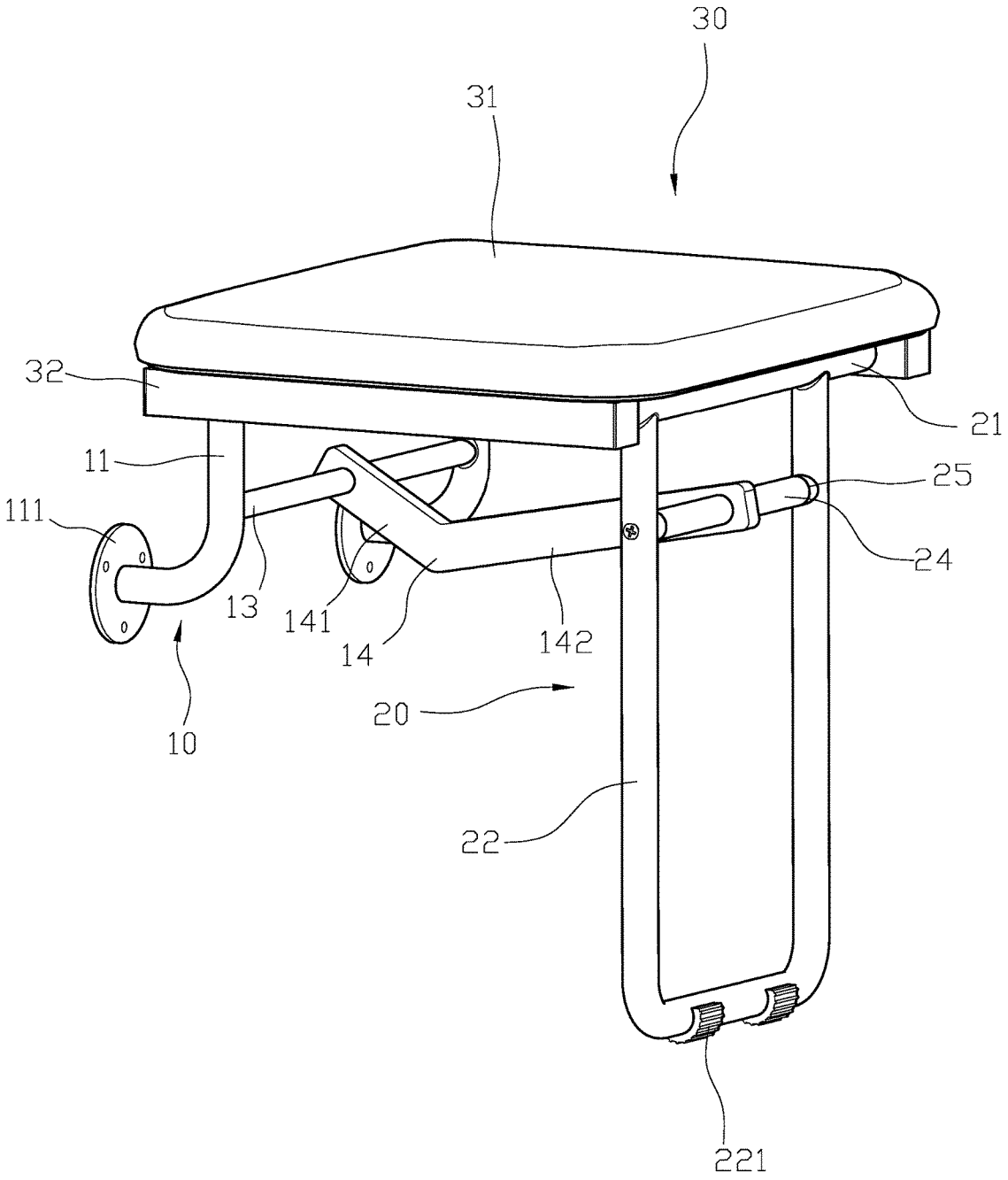
FIG. 1 is a perspective view of an embodiment of the present invention.
Figure 2:
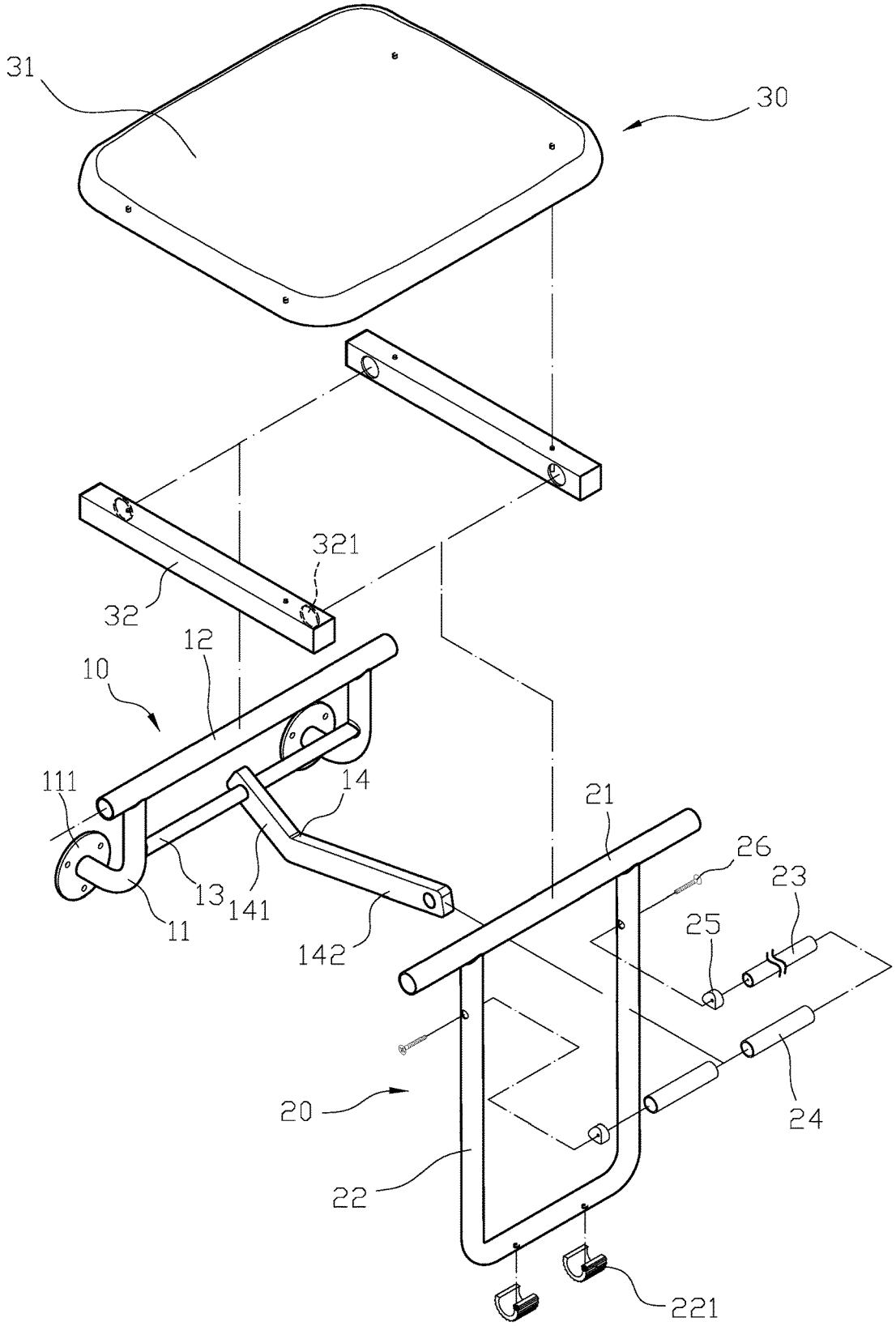
FIG. 2 is an exploded view of the embodiment of the present invention.
Figure 3:
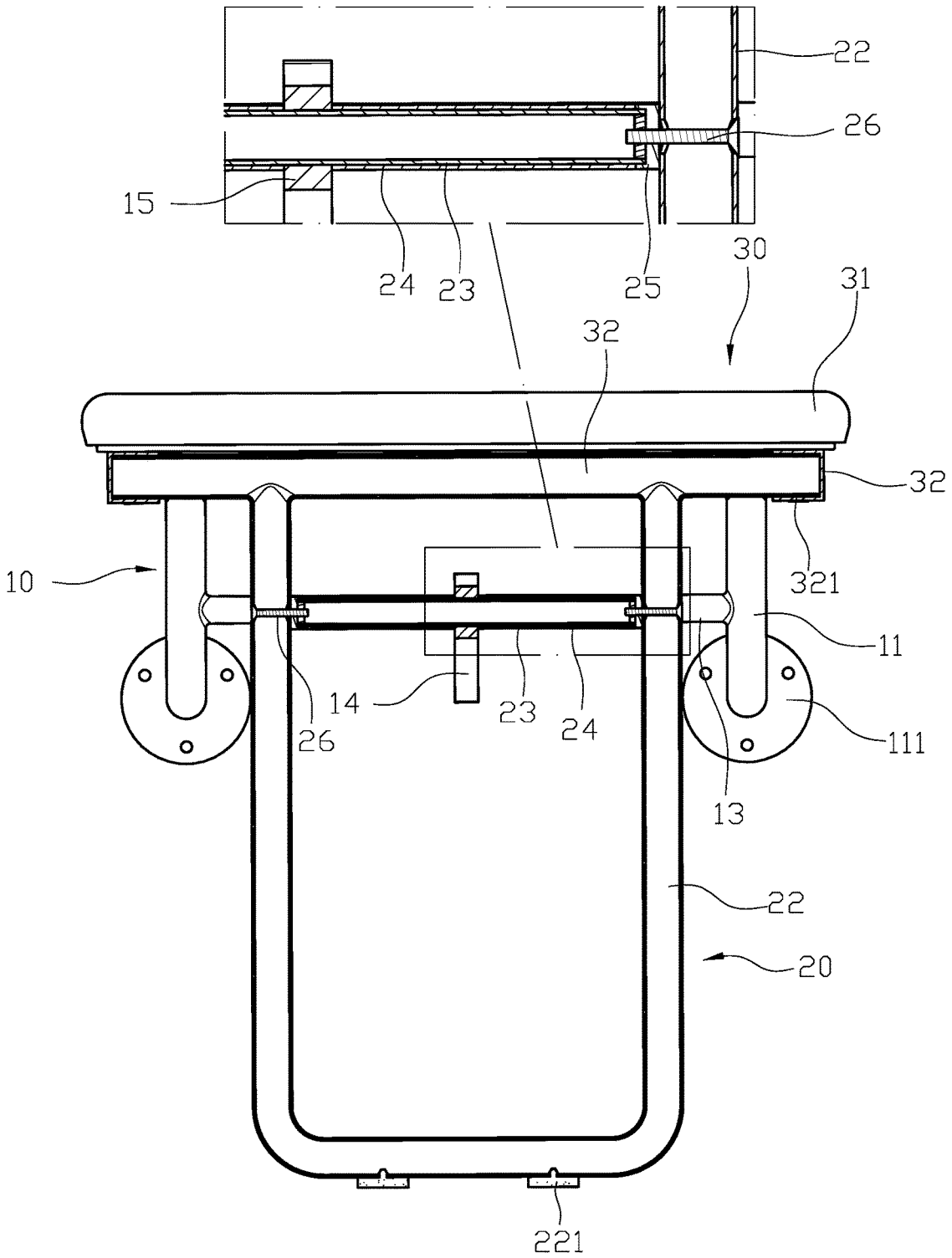
FIG. 3 is a partial sectional view of the embodiment of the present invention.

Please refer to FIG. 1 to FIG. 3. A wall-mounted the foldable chair comprises a supporting frame 10, a rotatable frame 20 and a seating member 30. The supporting frame 10 has two L-shaped assembling bars 11, and an end of each assembling bar 11 is fixed onto a wall surface with a mounting member 111. Another end of each assembling bar 11 is connected to a horizontal axial tube 12, and a shaft rod 13 is mounted parallel to the axial tube 12 between the two assembling bars 11 and provided with a pivoted connecting rod 14. The connecting rod 14 is bent and has an arm section 141 and a supporting section 142. The rotatable frame 20 is provided with a rotation shaft 21, at least two parallel supporting leg frames 22 connected to the rotation shaft 21, and a connecting bar 23 parallel to the rotation shaft 21 and between the two supporting leg 22. A bottom of each supporting leg member 22 of the rotatable frame 20 is connected to form a U-shape and further provided with an anti-slip pad 221. The connecting bar 23 is pivotally connected to another end of the connecting rod 14. The connecting bar 23 of the rotatable frame 20 is further sleeved with two side tubes 24 sandwiching the connecting rod 14 to position the connecting rod 14 at a middle of the connecting bar 23. Furthermore, an end of each of the two side tubes 24 is provided with a resilient plug 25, and the two resilient plugs 25 are configured to push against the two supporting leg members 22 and respectively engage the two ends of the connecting bar 23 by a locking member 26. Therefore, the rotatable frame 20 is able to rotate relative to the supporting frame 10 via the connecting rod 14. The seating member 30 has a pad member 31 and two parallel secure rods 32 below the pad member 31. Each of the two secure rods 32 respectively has two assembling holes 321 rotatably and respectively jacket onto two ends of the axial tube 12 of the supporting frame 10 and two ends of the rotation shaft 21 of the rotatable frame 20, to form a rectangular structure with the axial tube 12, the rotation shaft 21 and the two secure rods 32. Accordingly, the seating member 30 moves with the supporting frame 10 and the rotatable frame 20.

Figure 4:
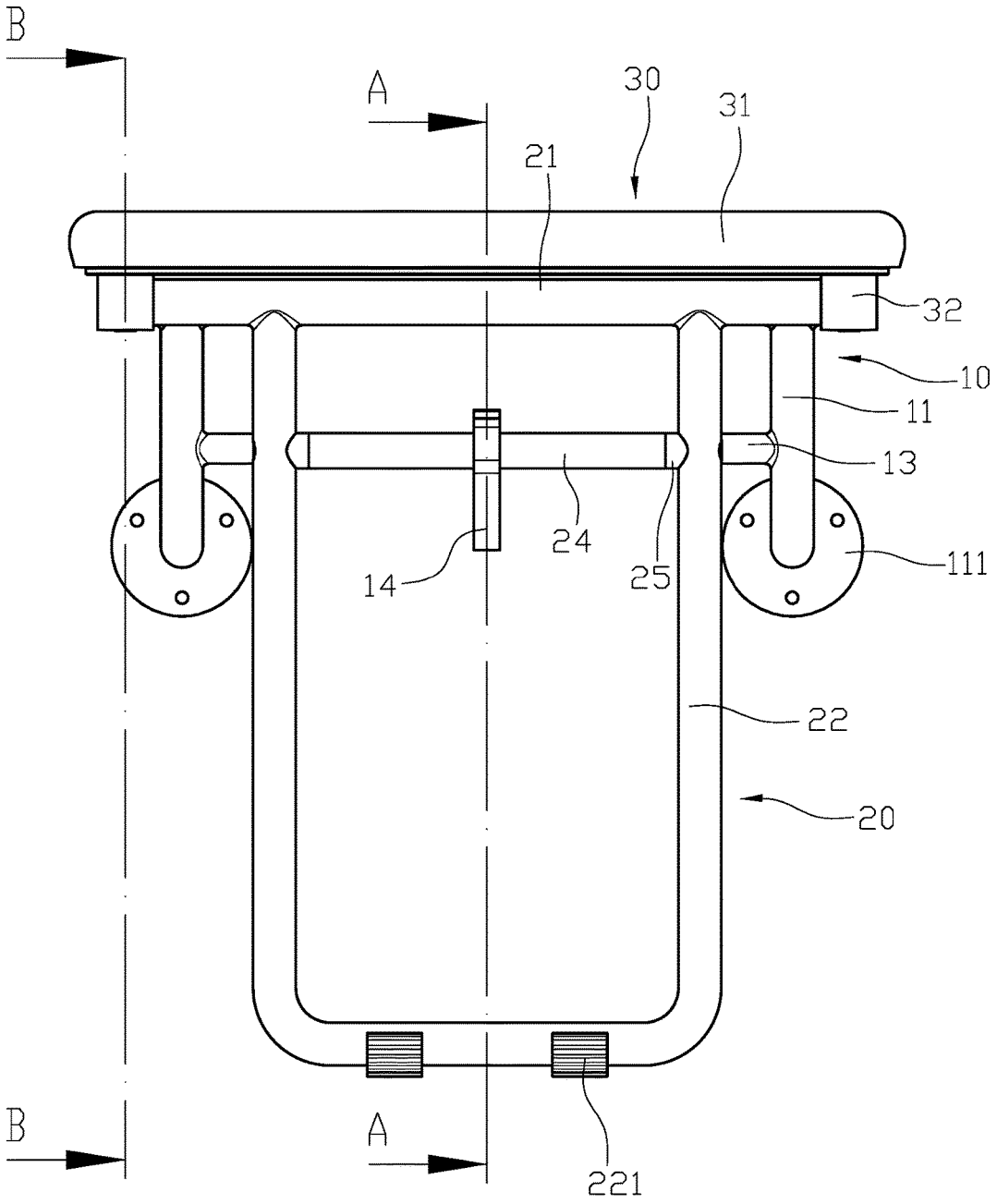
FIG. 4 is a front view of the embodiment of the present invention.

For structure assembly, please refer to FIGS. 2-4. The connecting rod 14 pivoted on the shaft rod 13 is connected to the connecting bar 23, both ends of the connecting bar 23 is respectively sleeved by one side tube 24, the two side tubes 24 both push against the connecting rod 14 to limit it at a middle of the connecting bar 23, and a soft plug 25 is respectively placed between one end of the side tube 24 and the supporting leg member 22. Finally, the supporting leg member 22 and the soft plug 25 are fastened and fixed together with the connecting bar 23 by the locking member 26, thereby pivoting the supporting frame 10 and the rotatable frame 20 together. The axial tube 12 and the rotation shaft 21 are parallel to each other, the two secure bars 32 are respectively sleeved on the axial tube 12 and the rotation shaft 21 through the through hole 321, and finally the pad member 31 is secured to an upper end of each two secure bar 32 to complete a wall-mounted foldable chair.

Figure 5:
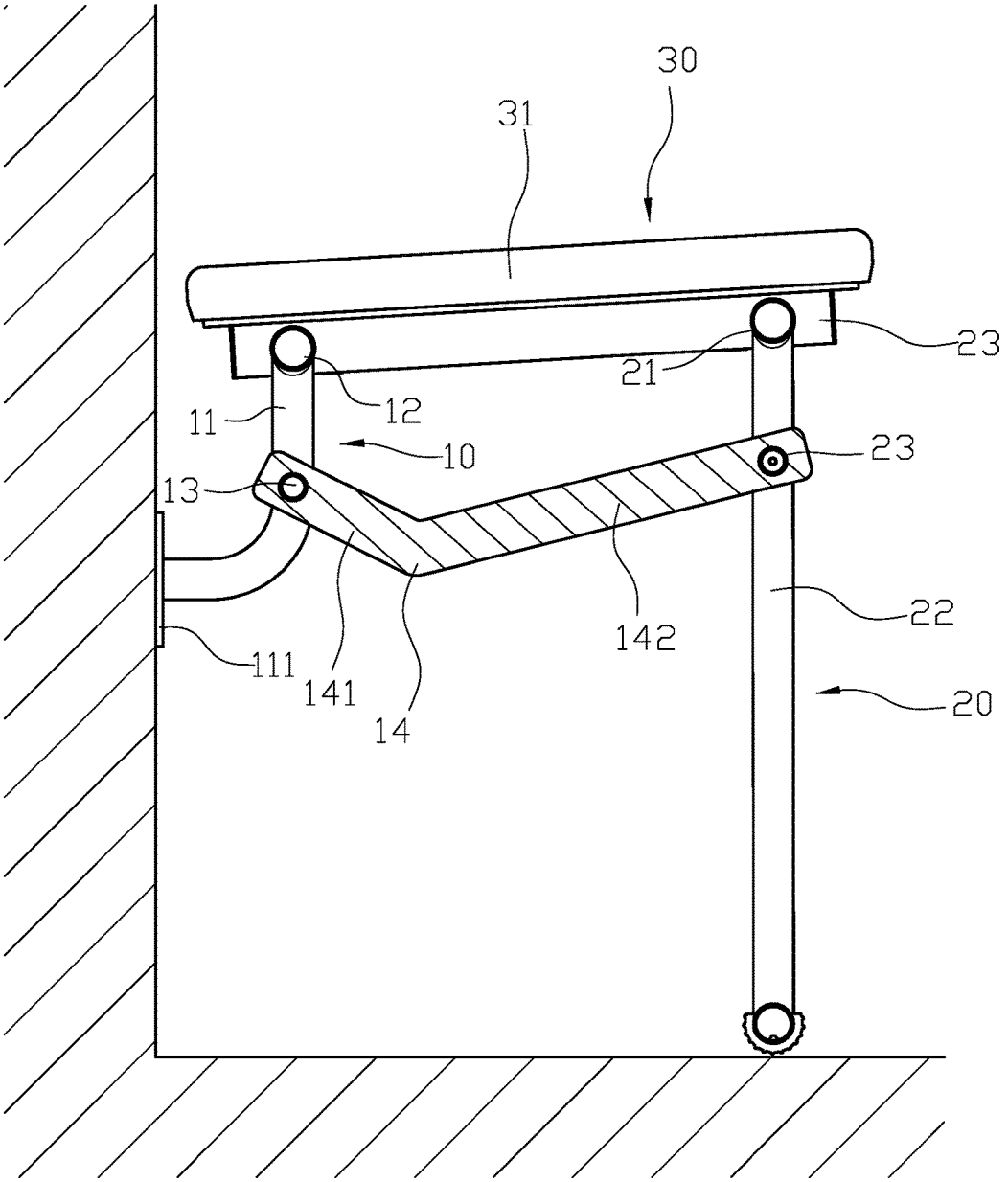
FIG. 5 is a cross-sectional view the embodiment of the present invention corresponding to along a line A-A shown in FIG. 4.
Figure 6:
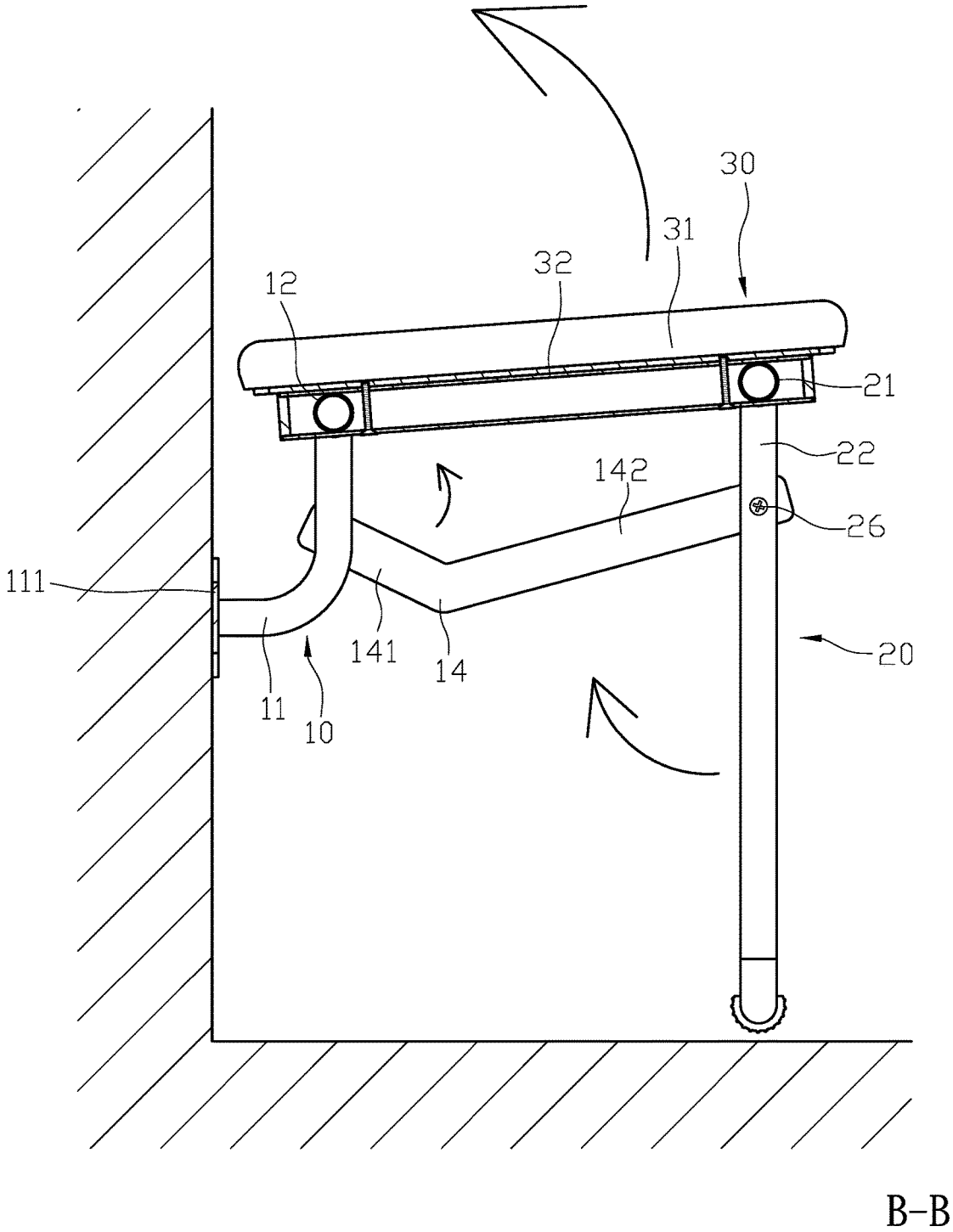
FIG. 6 is a cross-sectional view the embodiment of the present invention corresponding to along a line B-B shown in FIG. 4.
Figure 7:
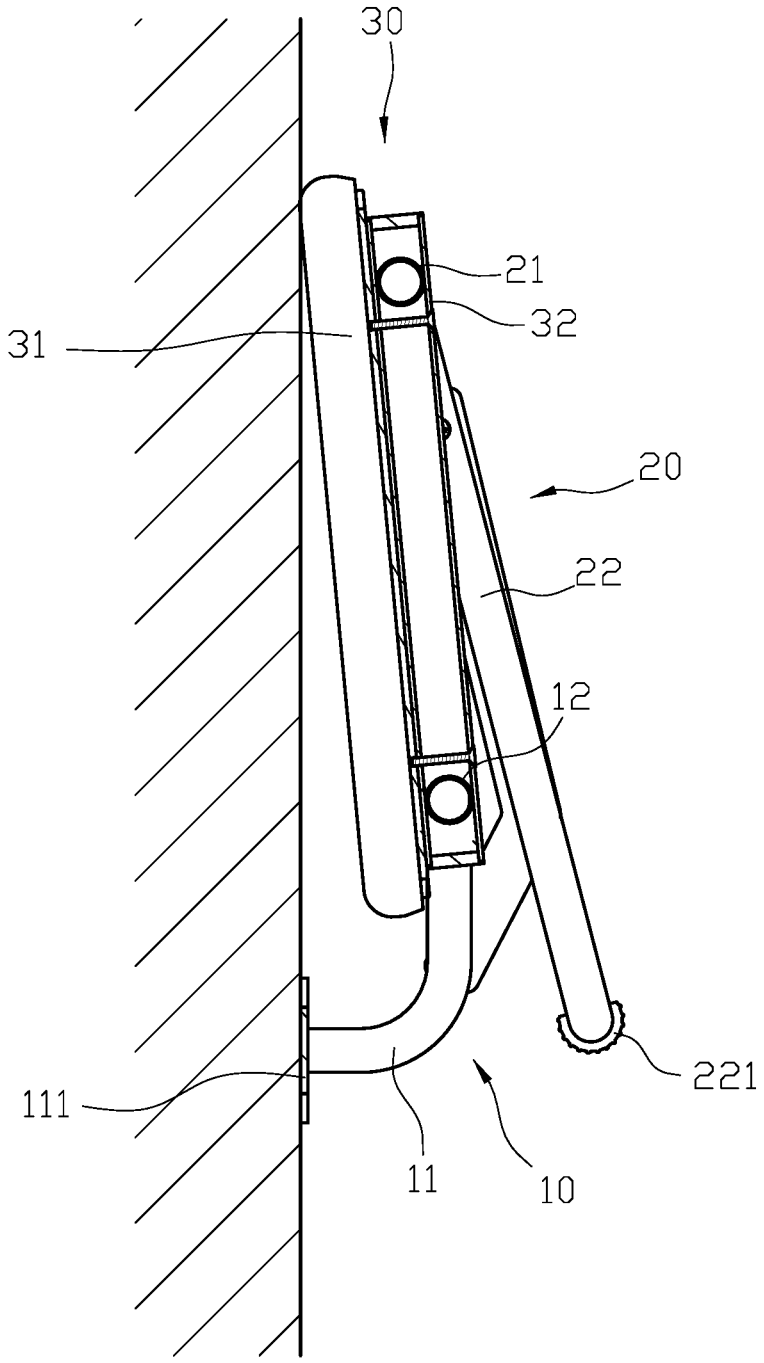
FIG. 7 is a schematic drawing of the embodiment of the present invention being folded.
Figure 8:
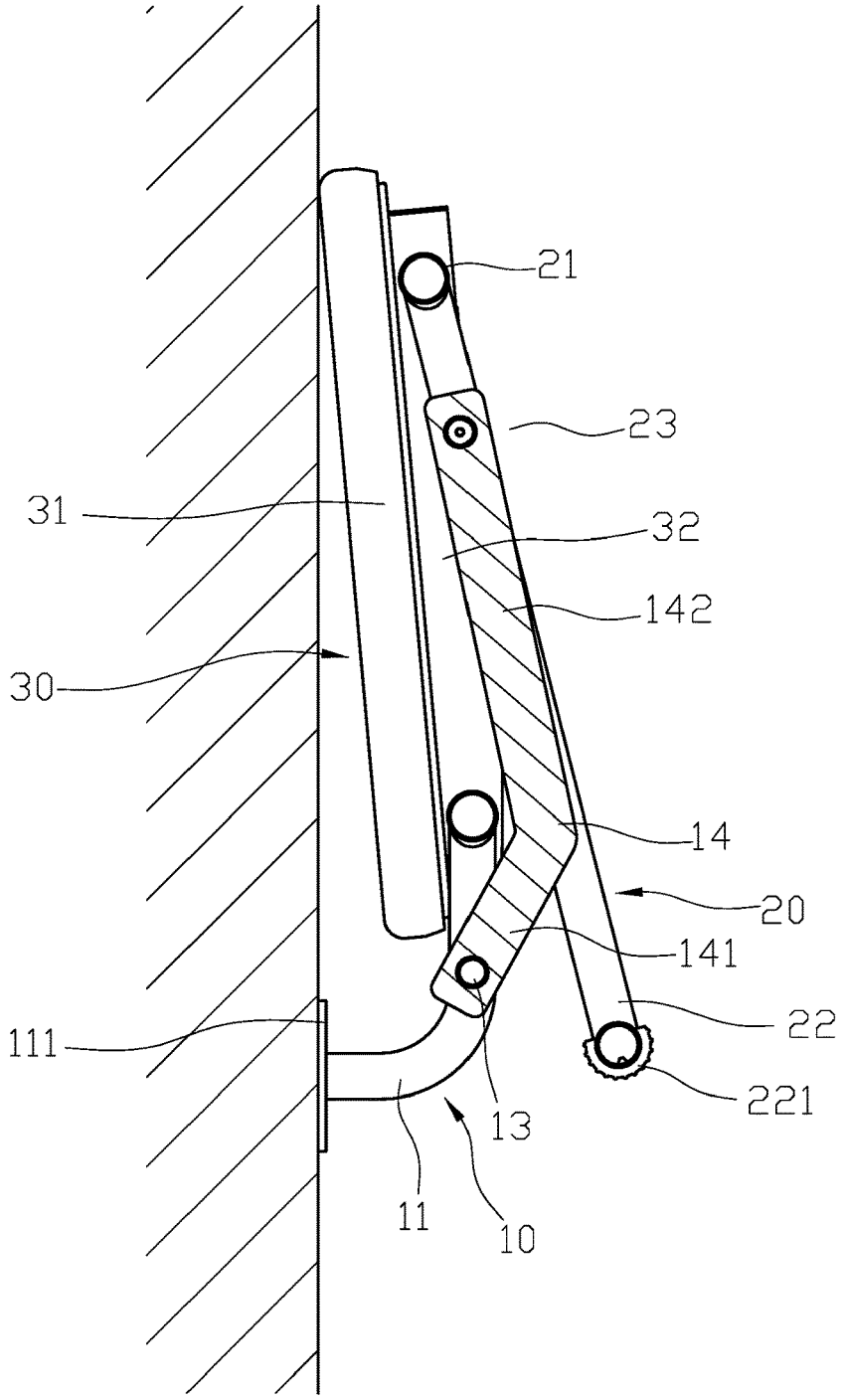
FIG. 8 is another schematic drawing of the embodiment of the present invention being folded.
Figure 9:
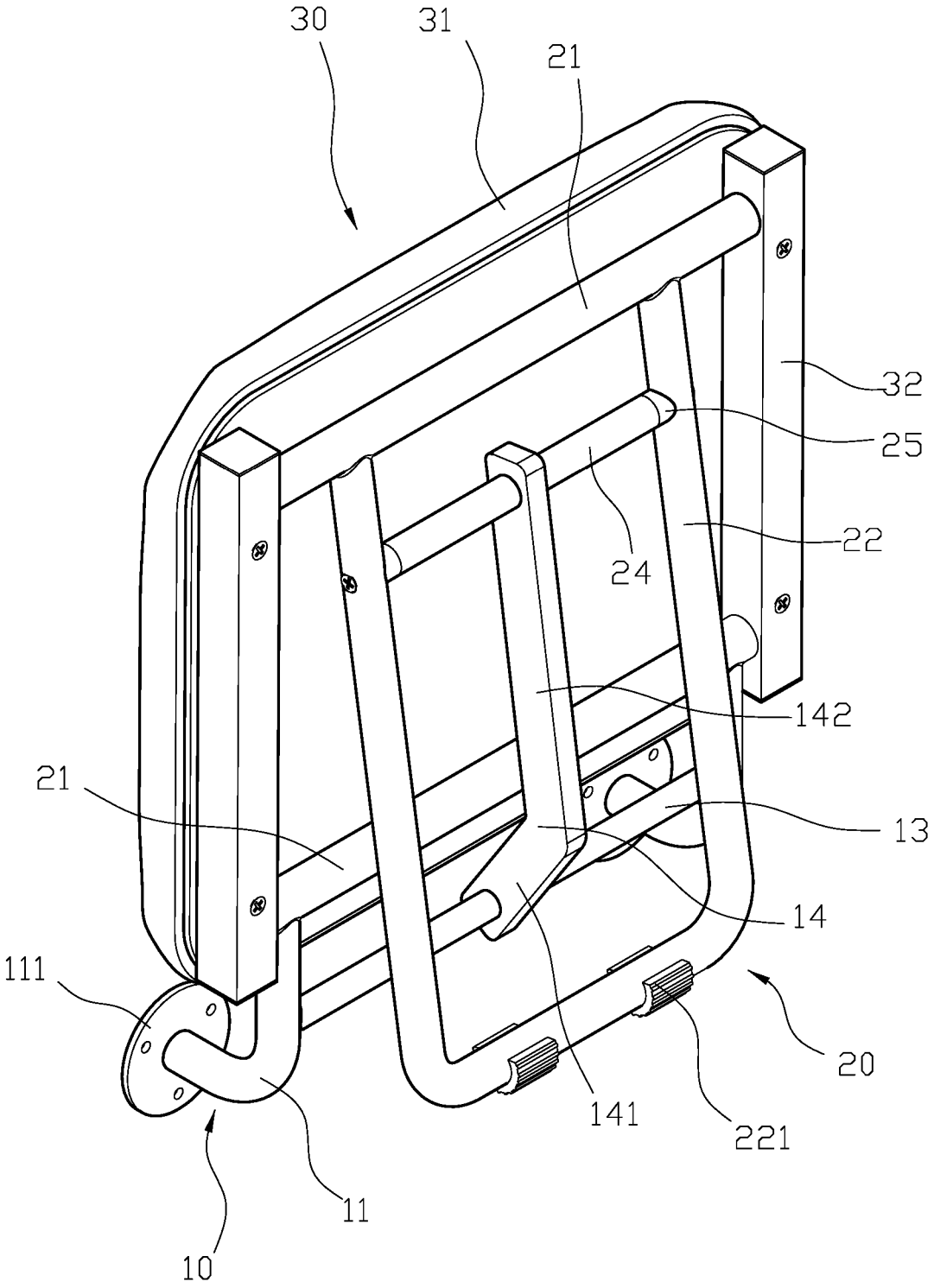
FIG. 9 is a perspective view of the embodiment of the present invention being folded.

For actual use, please refer to FIG. 1, FIG. 4 and FIG. 5. The supporting frame 10 is fixed on the wall by the mounting members 111 of the two assembling bars 11. During installation, the height of the supporting frame 10 allows the rotatable frame 20 to be surely lowered and the two supporting leg members 22 can naturally fall and stand on the ground. Therefore, when the seating member 30 is turned downward be flat the rotatable frame 20 is pushed out away from the rotation shaft 21 so that the two supporting leg members 22 can stand on the ground and being perpendicular with the pad member 31. In addition, the two supporting leg members 22 utilize the connection and relative position between the connecting rod 14 and the supporting frame 10 to limit the movement distance of the rotatable frame 20 to ensure the perpendicular state between the rotatable frame 20 and the seating member 30 for a more stable seating effect.

Furthermore, in order to store the structure, please see FIG. 6 to FIG. 9. First, the seating member 30 is flipped up about the axial tube 12, and then the rotatable frame 20 is pivoted inwardly about the rotation shaft 21 so that the two supporting leg members 22 are folded towards to the supporting frame 10 and retract the connecting rod 14.

By the structure of the above specific embodiments, the following benefits can be obtained:

(1) The chair frame structure needs less components, and the supporting frame 10, the rotatable frame 20 and the seating member 30 are easy to manufacture, which increases production efficiency, only needs a quick assembly, and reduces the cost of the structure.

(2) When the structure of the chair frame is unfolded, the opening frame 20 and the seating member 30 are perpendicular to each other and are supported on the ground by the two supporting leg members 22. Moreover, the rotatable frame 20 and the supporting frame 10 are connected and restricted by the connecting rod 14, to ensure the stability of the rotatable frame 20.

(3) The connecting rod 14 is bent to have the arm section 141 and the supporting section 142, which can drive the rotatable frame 20. When the rotatable frame 20 is to be retracted and folded, the rotatable frame 20 can be further folded closer to the supporting frame 10 due to the curved connecting rod 14, which substantially reduces the volume of the folded frame.

Although the present invention has been explained in relation to its preferred embodiment, it is to be understood that many other possible modifications and variations can be made without departing from the spirit and scope of invention as hereinafter claimed.

What is claimed is:

1. A wall-mounted foldable chair comprising:

a supporting frame having two L-shaped assembling bars, an end of each assembling bar fixed onto a wall surface, another end of each assembling bar connected to a horizontal axial tube, a shaft rod mounted parallel to the axial tube between the two assembling bars and provided with a pivoted connecting rod, the connecting rod being bent and having an arm section and a supporting section;

a rotatable frame provided with a rotation shaft, at least two parallel supporting leg frames connected to the rotation shaft, and a connecting bar parallel to the rotation shaft and between the two supporting leg frames, the connecting bar pivotally connected to another end of the connecting rod; and a seating member having a pad member and two parallel secure rods below the pad member, each of the two secure rods respectively having two assembling holes rotatably and respectively jacketing onto two ends of the axial tube of the supporting frame and two ends of the rotation shaft of the rotatable frame, to form a rectangular structure with the axial tube, the rotation shaft and the two secure rods;

wherein the connecting bar of the rotatable frame is further sleeved with two side tubes sandwiching the connecting rod to position the connecting rod at a middle of the connecting bar, and an end of each of the two side tubes is provided with a resilient plug, the two resilient plugs configured to push against the two supporting leg members and respectively engage the two ends of the connecting bar by a locking member.

2. The wall-mounted the foldable chair as claimed in claim 1, wherein each of the two assembling bars of the supporting frame has a mounting member at an end which is configured for mounting onto the wall.

3. The wall-mounted the foldable chair as claimed in claim 1, wherein a bottom of each supporting leg member of the rotatable frame is connected to form a U-shape.

4. The wall-mounted the foldable chair as claimed in claim 1, wherein a bottom of the supporting leg member is further provided with an anti-slip pad.

* * * * *